US009941607B2

(12) United States Patent
Miyazaki et al.

(10) Patent No.: US 9,941,607 B2
(45) Date of Patent: Apr. 10, 2018

(54) COAXIAL CABLE CONNECTOR, CARRIER-EQUIPPED COAXIAL CABLE CONNECTOR, AND METHOD FOR MANUFACTURING COAXIAL CABLE CONNECTOR

(71) Applicant: HIROSE ELECTRIC CO., LTD., Tokyo (JP)

(72) Inventors: Atsuhiro Miyazaki, Tokyo (JP); Ikuo Denpouya, Tokyo (JP); Yoshihito Hirose, Tokyo (JP); Kazuhiko Kimura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 15/338,870

(22) Filed: Oct. 31, 2016

(65) Prior Publication Data

US 2017/0125925 A1 May 4, 2017

(30) Foreign Application Priority Data

Oct. 29, 2015 (JP) ..... 2015-212611
Dec. 2, 2015 (JP) ..... 2015-235464

(51) Int. Cl.
*H01R 9/05* (2006.01)
*H01R 43/055* (2006.01)
*H01R 43/048* (2006.01)

(52) U.S. Cl.
CPC ..... *H01R 9/0518* (2013.01); *H01R 43/055* (2013.01); *H01R 43/0482* (2013.01)

(58) Field of Classification Search
CPC ..... H01R 43/055; H01R 43/24; H01R 43/20; H01R 9/05; H01R 9/0518; Y10T 29/53209
USPC ..... 439/581–585, 885; 29/874, 882, 884, 29/827
See application file for complete search history.

(56) References Cited

U.S. PATENT DOCUMENTS 3,163,485 A * 12/1964 Kruitwagen ..... H01R 4/16 206/717
6,700,066 B1 * 3/2004 Kuo ..... H01R 9/0512 174/74 R
6,712,645 B1 * 3/2004 Chou ..... H01R 9/0518 439/582
7,334,327 B1 * 2/2008 Chen ..... H01R 43/24 264/104

(Continued)

FOREIGN PATENT DOCUMENTS

JP 2011-181518 9/2011

*Primary Examiner* — Xuong Chung Trans
(74) *Attorney, Agent, or Firm* — Procopio, Cory, Hargreaves & Savitch LLP

(57) ABSTRACT

There is provided a coaxial cable connector, etc., configured such that the outer conductor shell and the connector carrier are linked by a carrier linkage part provided to part of the edge portion between the distal end and the portion of the outer conductor shell of a coaxial cable connector excluding the crimper, and the connector carrier is disposed on the distal end side of the outer conductor shell (the opposite side from the housing carrier), which simplifies the configuration of the apparatus used to manufacture the coaxial cable connector, and allows the coaxial cable connector to be assembled with the fixing position of the outer conductor shell stabilized while still linked to the connector carrier in the manufacturing process.

20 Claims, 9 Drawing Sheets

(56) References Cited

U.S. PATENT DOCUMENTS

| | | | | |
|---|---|---|---|---|
| 7,909,645 | B2 * | 3/2011 | Mulfinger | H01R 9/0518 439/578 |
| 8,298,010 | B2 * | 10/2012 | Matsumoto | H01R 9/0518 439/582 |
| 2014/0206245 | A1 * | 7/2014 | Sato | H01R 43/005 439/878 |

* cited by examiner

COAXIAL CABLE CONNECTOR, CARRIER-EQUIPPED COAXIAL CABLE CONNECTOR, AND METHOD FOR MANUFACTURING COAXIAL CABLE CONNECTOR

This application claims the priority of Japanese Patent Application Nos. 2015-212611, filed on Oct. 29, 2015 and 2015-235464, filed on Dec. 2, 2015, the contents of which is incorporated by reference in its entirety.

BACKGROUND

1. Technical Field

The present invention relates to a coaxial cable connector. More specifically, present invention relates to a coaxial cable connector comprising cut parts that are separated from the carrier, and to a coaxial cable connector equipped with a carrier linked to one or more coaxial cable connectors, and to a method for manufacturing a coaxial cable connector that includes at least a step of separating the outer conductor shell from the carrier linked by a carrier linkage part.

2. Background Art

In a conventional process for manufacturing a coaxial cable connector or other such connector, a connector carrier linked by a linking piece to the rear end of the outer conductor shell of the connector is on the same side as a housing carrier linked by a linking piece to the rear end of a terminal that is housed in or built into a housing by integral molding or the like. The connector carrier and housing carrier that are on the same side are each positioned, and assembly is performed to house an insulated housing in the outer conductor shell.

The rear end of the outer conductor shell here is the end to the rear with respect to the extension direction of a coaxial cable connected to the outer conductor shell, and similarly, the rear end of the terminal is the end to the rear with respect to the extension direction of the coaxial cable. The distal end of the outer conductor shell and the distal end of the terminal are the ends to the front with respect to the extension direction of the coaxial cable.

For example, with the connector discussed in Japanese Laid-Open Patent Application 2011-181518, a carrier (connector carrier) linked to the outer conductor shell of the connector via a linking piece is on the same side as a carrier (housing carrier) linked to a center contact built into the housing via a linking piece, and these carriers are positioned one over the other on the same side, and the housing is mounted in the outer conductor shell to complete the assembly.

PRIOR ART DOCUMENTS

Patent Document

Patent Document 1: Japanese Laid-Open Patent Application 2011-181518

SUMMARY

As in the conventional example discussed above, in a typical process for manufacturing a coaxial cable connector or other such connector, since the connector carrier and the housing carrier are on the same side, the jigs (or mechanisms) for supporting the carriers have to be designed so as not to impede movement, through positioning of the jigs, etc. Since the design of the jigs that support the two carriers on the same side thus has to take into account the positional relation of the carriers, their movement range, and so forth, the structure of the jigs is more complicated than the structure of a jig that supports just one carrier.

Also, since the rear end of the outer conductor shell of the connector is linked to the connector carrier via a linking piece, the connector carrier impedes connection in the compression connection of a coaxial cable to the rear end portion of the outer conductor shell, so in the course of manufacturing a coaxial cable connector, before the coaxial cable is compression connected to the rear end portion of the outer conductor shell, the connector carrier is cut away from the rear end of the outer conductor shell, and a clamp or other such jig is required to clamp and fix the coaxial cable connector that has been separated from the connector carrier.

Accordingly, the apparatus for manufacturing the coaxial cable connector has a complicated structure that comprises this clamp or other such jig. Furthermore, compared to when the coaxial cable connector is linked to the connector carrier, since it is merely fixed with a clamp or other such jig, the fixing position of the coaxial cable connector can become unstable in the compression connection of the coaxial cable.

In view of this, there are provided a coaxial cable connector, a connector carrier-equipped coaxial cable connector, and a method for manufacturing a coaxial cable connector, configured such that, instead of linking the rear end of the outer conductor shell of the connector with a linking piece as in prior art, or in addition to linking the rear end of the outer conductor shell with a linking piece, the outer conductor shell and the connector carrier are linked by a carrier linkage part provided at the desired location closer to the distal end side than the crimper of the outer conductor shell constituting the coaxial cable connector, and the connector carrier is disposed on the distal end side of the outer conductor shell (that is, the opposite side from the housing carrier linked to the rear end of the terminals built into the insulated housing), which simplifies the configuration of the apparatus for manufacturing the coaxial cable connector, including the jigs or the like for supporting the carriers, and in the compression connection of the coaxial cable to the rear end portion of the coaxial cable connector, allows the fixing position of the coaxial cable connector to be stabilized while still linked to the connector carrier and the coaxial cable can be connected to the coaxial cable connector in this state, without cutting the coaxial cable connector away from the connector carrier.

A coaxial cable connector pertaining to one embodiment of the present invention includes: terminals, a housing that supports the terminals, an outer conductor shell that covers at least part of the housing and at least part of a coaxial cable, and a coaxial cable;

wherein a crimper for fixing the coaxial cable is provided to the rear end portion of the outer conductor shell, cut parts are provided to the outer conductor shell at least at desired locations closer to the distal end side than the crimper, and the cut parts are what is left behind after cutting away from a connector carrier.

In an embodiment of the coaxial cable connector pertaining to the present invention, the cut parts are formed at the edge portions closer to the distal end side than the crimper.

In an embodiment of the coaxial cable connector pertaining to the present invention, the coaxial cable connector comprises wall components that are provided to the edge portions of the outer conductor shell, and the cut parts are formed at the edge portions of the outer conductor shell where the wall components are not located.

In an embodiment of the coaxial cable connector pertaining to the present invention, the coaxial cable connector includes a substantially cylindrical part for connecting a mating connector to the distal end side of the outer conductor shell, wherein the cut parts are formed to the outside of the outer periphery of the substantially cylindrical part.

In an embodiment of the coaxial cable connector pertaining to the present invention, the cut parts are formed in a convex shape from the edge portions of the outer conductor shell.

In an embodiment of the coaxial cable connector pertaining to the present invention, the coaxial cable connector includes a bending part that constitutes part of the substantially cylindrical part, at the distal end of the outer conductor shell, wherein the cut parts are formed at the ends of the bending part.

In an embodiment of the coaxial cable connector pertaining to the present invention, the coaxial cable connector comprises other cut parts at the end of the crimper, in addition to the cut parts provided at desired locations closer to the distal end side than the crimper.

A connector carrier-equipped coaxial cable connector pertaining to one embodiment of the present invention includes at least one coaxial cable connector comprising terminals, a housing that supports the terminals, and an outer conductor shell that covers at least part of the housing and at least part of a coaxial cable, wherein a crimper for fixing the coaxial cable is provided to the outer conductor shell, and the outer conductor shell is such that a carrier linkage part that is linked to the connector carrier is provided at a desired location closer to the distal end side than the crimper.

In an embodiment of the connector carrier-equipped coaxial cable connector pertaining to the present invention, the carrier linkage part is provided to the edge portions closer to the distal end side than the crimper.

In an embodiment of the connector carrier-equipped coaxial cable connector pertaining to the present invention, the coaxial cable connector comprises wall components at the edge portions of the outer conductor shell, and the carrier linkage part is provided to the edge portions of the outer conductor shell where the wall components are not located.

In an embodiment of the connector carrier-equipped coaxial cable connector pertaining to the present invention, the coaxial cable connector includes a substantially cylindrical part for connecting a mating connector to the distal end side of the outer conductor shell, and the carrier linkage part is provided to the outside of the outer periphery of the substantially cylindrical part.

In an embodiment of the connector carrier-equipped coaxial cable connector pertaining to the present invention, the carrier linkage part is formed in a convex shape from the edge portion of the outer conductor shell.

In an embodiment of the connector carrier-equipped coaxial cable connector pertaining to the present invention, the coaxial cable connector includes a bending part that constitutes part of the substantially cylindrical part, at the distal end of the outer conductor shell, and the carrier linkage part is formed at the end of the bending part.

In an embodiment of the connector carrier-equipped coaxial cable connector pertaining to the present invention, the coaxial cable connector is engaged with the carrier linkage part via a linkage piece extending from the connector carrier.

In an embodiment of the connector carrier-equipped coaxial cable connector pertaining to the present invention, a notch or a half-cut is formed in the carrier linkage part.

In an embodiment of the connector carrier-equipped coaxial cable connector pertaining to the present invention, the coaxial cable connector comprises another carrier linkage part at the end of the crimper in addition to the carrier linkage part provided at a desired location closer to the distal end side than the crimper, the other carrier linkage part is linked to a sub-connector carrier that supports the crimper of the outer conductor shell, and the connector carrier is connected to a support component at the distal end of a support piece extending from the sub-connector carrier.

A method for manufacturing a coaxial cable connector pertaining to one embodiment of the present invention includes at least a step of cutting away the connector carrier by cutting the carrier linkage part provided at a desired location closer to the distal end side than the crimper from the connector carrier-equipped coaxial cable connector.

A method for manufacturing a coaxial cable connector pertaining to one embodiment of the present invention includes at least a step of cutting a sub-carrier away from the connector carrier by cutting the other carrier linkage part provided to the end of the crimper from the connector carrier-equipped coaxial cable connector, and cutting between the connector carrier and the support component at a cutting location, and a step of cutting away the connector carrier by cutting the carrier linkage part provided at a desired location closer to the distal end side than the crimper.

In an embodiment of manufacturing a coaxial cable connector pertaining to the present invention, the crimper includes a covering crimper and an outer conductor crimper, the outer conductor shell of the coaxial cable connector further comprises a core wire crimper, and before the step of cutting away the connector carrier, there are provided:

a step of fitting the housing that supports the terminals into the outer conductor shell; and a step of bending the core wire crimper extending from the edge portion of the outer conductor shell so that the core wire of the coaxial cable disposed in a core wire connector of the terminals is compressed and connected to the core wire connector by a core wire fixing component that is insulated and is located on the inside of the core wire crimper, and respectively crimping and fixing the outer conductor and the covering of the coaxial cable with the outer conductor crimper and the covering crimper provided to the rear end portion of the outer conductor shell.

In an embodiment of manufacturing a coaxial cable connector pertaining to the present invention, the crimper includes a covering crimper and an outer conductor crimper, the outer conductor shell of the coaxial cable connector further comprises a core wire crimper, and before the step of cutting away the connector carrier, there are provided:

a step of connecting the core wire of the coaxial cable to the core wire connector of the terminals supported in the housing;

a step of fitting the housing that supports the terminals, in which the core wire of the coaxial cable is wired to the core wire connector, into the outer conductor shell; and a step of bending the core wire crimper extending from the edge portion of the outer conductor shell so that the housing that supports the terminals is fixed to the outer conductor shell, and crimping and fixing the outer conductor and the covering of the coaxial cable with the outer conductor crimper and the covering crimper provided to the rear end portion of the outer conductor shell.

In an embodiment of manufacturing a coaxial cable connector pertaining to the present invention, the crimper includes a covering crimper and an outer conductor crimper, the outer conductor shell of the coaxial cable connector further comprises a core wire crimper, and before the step of cutting away the connector carrier, there are provided:

a step of fitting an insulated housing that does not support any terminals;

a step of fitting terminals, in which the core wire of the coaxial cable is connected to the core wire connector, to the housing; and a step of bending the core wire crimper extending from the edge portion of the outer conductor shell so that the housing that supports the terminals is fixed to the outer conductor shell, and crimping and fixing the outer conductor and the covering of the coaxial cable with the outer conductor crimper and the covering crimper provided to the rear end portion of the outer conductor shell.

Because the outer conductor shell and the connector carrier are linked by a carrier linkage part provided at a desired location on the edge portion between the core wire crimper used for fixing the core wire of the coaxial cable and the distal end of the outer conductor shell, and the connector carrier is disposed on the distal end side of the outer conductor shell, the connector carrier can be disposed on the opposite side from the housing carrier, so there is no need to take into account the movement range of the carriers, their positional relation, and so forth, and the configuration of the manufacturing apparatus, including jigs and so forth, can be simplified.

Also, in the compression connection of the coaxial cable to the rear end portion of the coaxial cable connector, since the coaxial cable connector is not cut away from the connector carrier, the fixing position of the coaxial cable connector is stabilized while still linked to the connector carrier, and the coaxial cable can be connected to the coaxial cable connector in this state. Consequently, the clamp or other such mechanism for clamping and fixing the coaxial cable connector can be eliminated. Furthermore, since the coaxial cable connector can be handled in a state in which it is linked to the connector carrier, inspection and other such steps can be carried out more easily after the connection of the coaxial cable.

DETAILED DESCRIPTION

An embodiment of the present invention will now be described through reference to the drawings. In all of the drawings used for describing embodiments, those members that are the same will, as a rule, be numbered the same and will not be described more than once.

Figure 1:
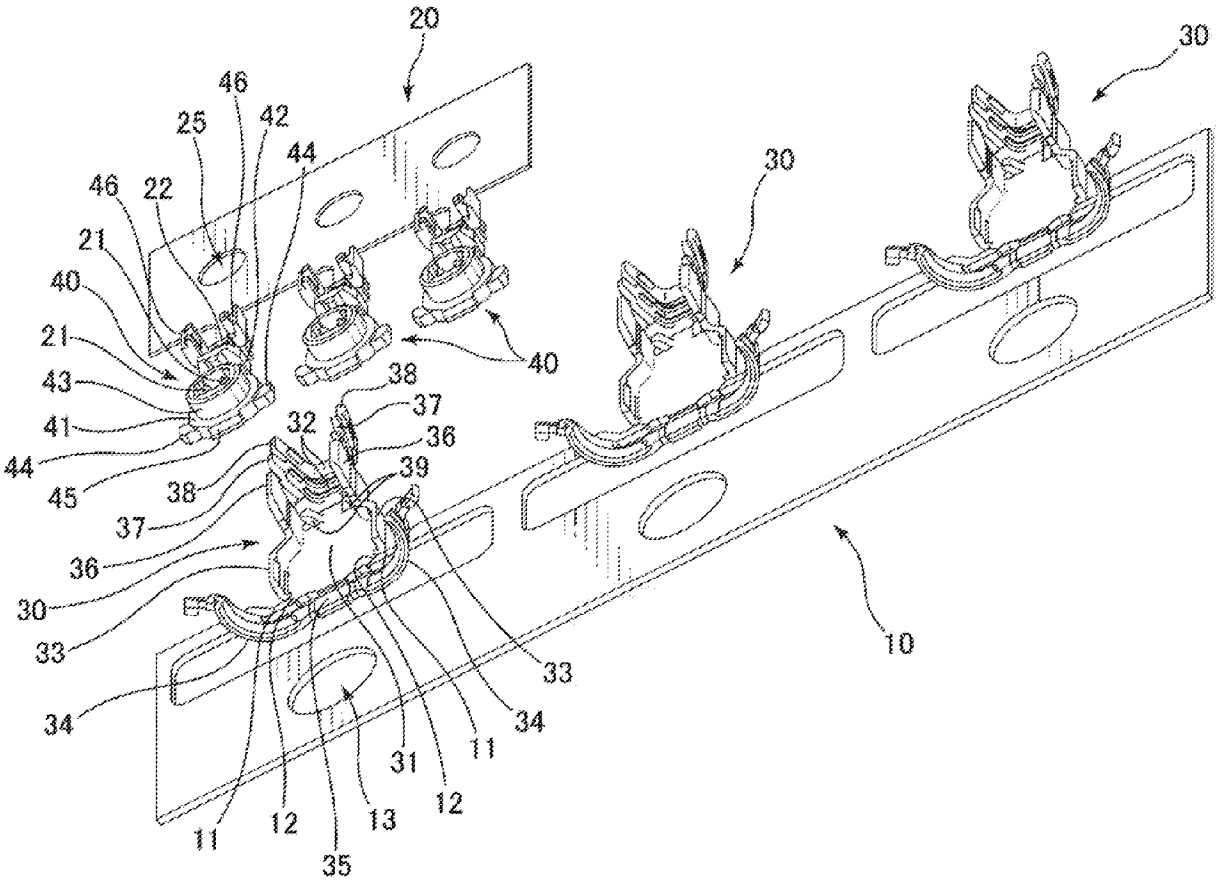
FIG. 1 An oblique view of the state when the insulated housings and the outer conductor shells constituting the coaxial cable connectors pertaining to an embodiment of the present invention are each linked to a carrier.
Figure 2:
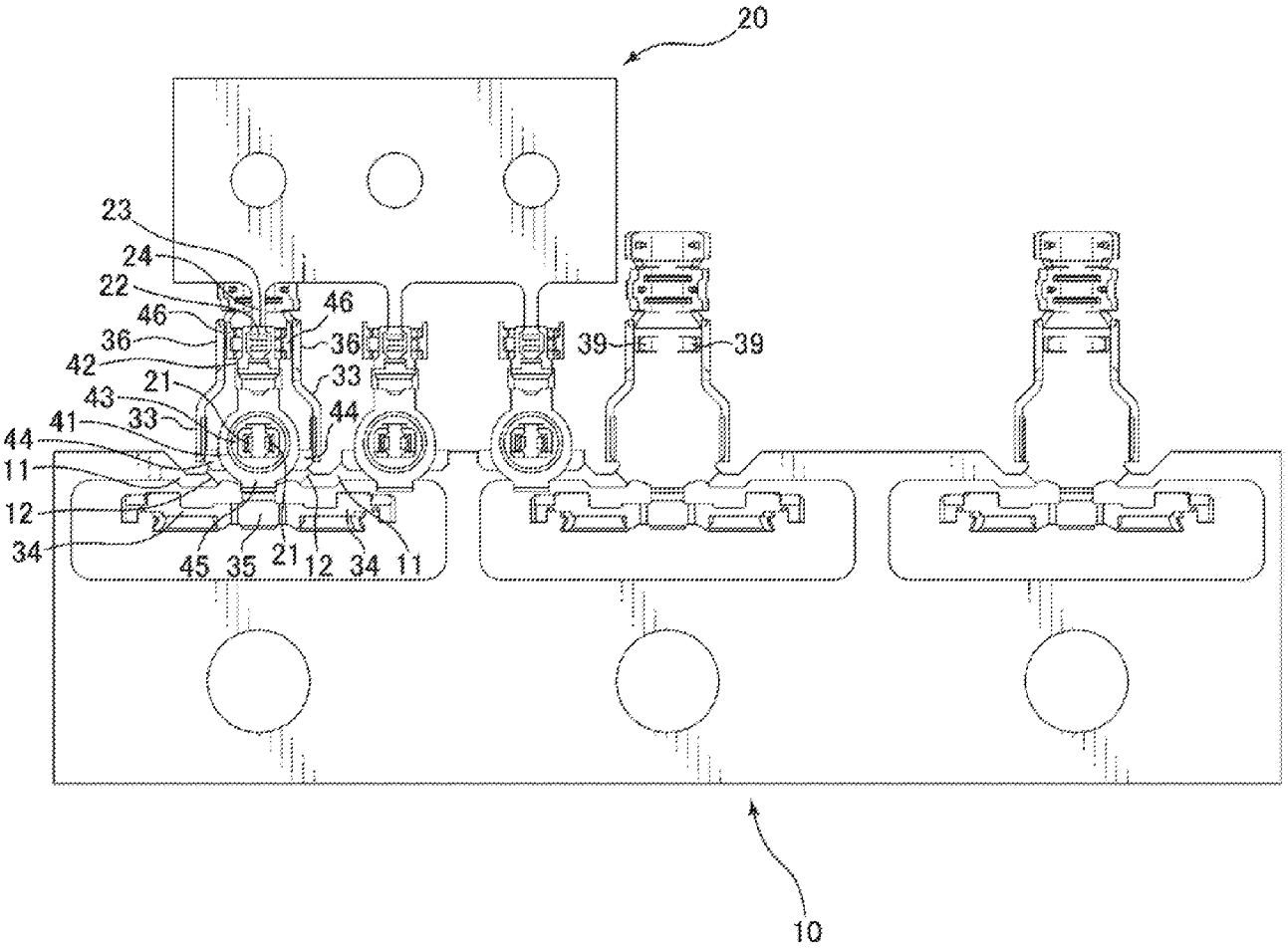
FIG. 2 A top view of the insulated housings and outer conductor shells shown in FIG. 1, as seen from above.

FIGS. 1 and 2 show the state when the insulated housings and the outer conductor shells constituting the coaxial cable connectors pertaining to an embodiment of the present invention are each linked to a carrier. FIG. 1 is an oblique view of a connector carrier 10 and a housing carrier 20, and FIG. 2 is a top view of the connector carrier 10 and the housing carrier 20 shown in FIG. 1, as seen from above. For the sake of description, the connector carrier 10 shown in FIGS. 1 and 2 links three outer conductor shells 30 constituting a coaxial cable connector, but naturally the number is not limited to three, and one or more of these may be linked. Similarly, the housing carrier 20 links three housings 40, but the number is not limited to three, and one or more of these may be linked. The same applies to the connector carrier and housing carrier shown in FIGS. 3 to 6 and FIGS. 8 and 9.

The connector carrier 10 links the outer conductor shells 30 with carrier linkage parts 12 via linking pieces 11 that stick out so as to support the outer conductor shells 30. In manufacturing a coaxial cable connector, positioning pilots 13 that serve as references for positioning the outer conductor shells 30 can be provided as needed to the connector carrier 10. The positioning pilots 13 shown in FIGS. 1 and 2 are holes through the connector carrier 10, but instead of through-holes, they may be protrusions, recesses, or anything else that can serve as a reference.

In the course of manufacturing a coaxial cable connector, the carrier linkage parts 12 are cut to separate the outer conductor shells 30 from the connector carrier 10. To make it easier to cut away the outer conductor shells 30 from the connector carrier 10, a half-cut, consisting of a cutout or other such notch made about half-way through, can be formed in the carrier linkage parts 12.

The housings 40 can be molded integrally so as to support the terminals, and the terminals are built into them, with the middle portion of the terminals covered. The housing carrier 20 links the terminals included in the housings 40 with carrier linking components 23 via linking pieces 24 extending so as to support the terminals included in the housings 40. That is, the housing carrier 20 can support the housings 40 by linking the rear ends of core wire connectors 22 provided on the rear end side of the terminals built into the housings 40 (that is, the side on which the coaxial cables are connected) with the carrier linking components 23 via the linking pieces 24.

The housing carrier 20 can be provided as needed with positioning pilots 25 that serve as a reference for positioning the housings 40 in the manufacture of a coaxial cable connector. The positioning pilots 25 shown in FIGS. 1 and 2 are similar to the positioning pilots 13 of the connector carrier 10 in that they are holes through the housing carrier 20, but in addition to through-holes, they may instead be protrusions, recesses, or something else that will serve as a reference.

In the coaxial cable connector manufacturing process, the terminals built into the housings 40 can be separated from the housing carrier 20 by cutting the carrier linking components 23. Just as with the carrier linkage parts 12 of the outer conductor shells 30, a half-cut, consisting of a cutout or other such notch made about half-way through, can be formed in the carrier linking components 23 to make it easier to cut away the terminals built into the housings 40 from the housing carrier 20.

The outer conductor shells 30 comprise on their distal end side (that is, on the distal end side of the coaxial cable) housing accommodation components 31 configured to accommodate the cylindrical bases 41 of the housings 40, and comprise on their rear end side crimpers (connecting components) 32 configured to connect the outer conductors and covers of the coaxial cables. Walls 33 that are perpendicular to the plane of the housing accommodation components 31 are provided to the edge portions of the outer conductor shells 30. The walls 33 can each be formed, for example, by perpendicularly bending the edge up to the position where a core wire crimper 36 extends from the distal end of the outer conductor shell 30.

Also, the outer conductor shells 30 comprise substantially cylindrical parts 34 that are configured to surround the cylindrical parts 43 of the housings 40, hold down the protrusions 44 protruding from the side faces of the cylindrical bases 41, and fix the housings 40. Bending parts 35 are provided to the distal end portions of the outer conductor shells 30, and constitute part of the cylindrical parts 34. In the process of manufacturing coaxial cable connectors, the bending parts 35 are bent perpendicular to the plane of the housing accommodation components 31, using protrusions 45 as a reference, and the cylindrical parts 34 that extend from both sides of the bending parts 35 are bent at the bending parts 35 so as to surround the cylindrical parts 43 of the housings 40.

The outer conductor shells 30 further comprise crimpers, for fixing a coaxial cable, at their rear end portion. These crimpers each include covering crimpers 38 and outer conductor crimpers 37. In addition to the covering crimpers 38 and the outer conductor crimpers 37, core wire crimpers 36 that extend from the walls 33 are provided to the edge portions in the middle of the outer conductor shells 30. The core wire crimpers 36 are configured to bend in a box shape at the walls 33, thereby indirectly compressing and connecting the core wires of the coaxial cable disposed in the core wire connectors 22 with core wire fixing components 46 of the housings 40 on the inside. The outer conductor crimpers 37 and the covering crimpers 38 used for fixing are provided to the rear end portions of the outer conductor shells 30. The outer conductor crimpers 37 are configured to directly crimp, in a cylindrical shape, the outer conductors of the coaxial cables disposed in the crimpers 32, and thereby fix them to the outer conductor shells 30. The covering crimpers 38 are configured to directly crimp, in a cylindrical shape, the coverings of the coaxial cables, and thereby fix them to the outer conductor shells 30. Raised springs 39 that are formed by cutting and lifting the flat portion in the center of the outer conductor shells 30 (that is, the flat portion sandwiched by the walls 33 from which the core wire crimpers 36 extend) are provided to these flat portions, and the raised springs 39 are configured to engage with the main body parts 42 of the housings 40.

The housings 40 comprise the cylindrical bases 41 on the distal end side of the coaxial cable connectors and comprise the main body parts 42 on the rear end side. The cylindrical bases 41 comprise the cylindrical parts 43 extending to the side that connects with a mating connector, and on the side faces comprise protrusions 44 and 45 extending perpendicularly to the cylindrical parts 43. The protrusions 44 are held down by the substantially cylindrical parts 34 of the outer conductor shells 30 in the course of manufacturing the coaxial cable connectors, allowing the cylindrical bases 41 placed in the housing accommodation components 31 to be fixed. The main body parts 42 comprise holes (not shown) configured so as to engage with the raised springs 39 of the outer conductor shells 30. When the housings 40 are put into the outer conductor shells 30, the main body parts 42 engage with the raised springs 39, allowing the housings 40 to be fixed.

The cylindrical parts 43 expose the contacts 21 of the terminals from the side that is connected to the mating connectors. The main body parts 42 on the rear end side of the housings 40 comprise the core wire fixing components 46 that expose the core wire connectors 22 of the terminals from the side where the core wires of the coaxial cables are connected and extend to the side where the core wires of the coaxial cables are connected. The core wire fixing components 46 are configured to extend from the edge portions of the main body parts 42, which are on both sides of the core wire connectors 22, and so that the core wire fixing components 46 are disposed on the inside of the core wire crimpers 36 when the housings 40 are put into the outer conductor shells 30.

As shown in FIG. 2, the carrier linkage parts 12 are provided so as to extend from the flat faces of the housing accommodation components 31. For example, if the carrier linking components 23 are provided so as to extend from the flat faces of the housing accommodation components 31 at positions on the distal end side where the walls 33 of the outer conductor shells 30 are interrupted, then the connector carrier 10 can be disposed on the distal end side of the outer conductor shells 30, and the connector carrier 10 can be disposed on the opposite side from the housing carrier 20 where the rear ends of the terminals built into the housings 40 are linked by the carrier linking components 23 via the linking pieces 24.

Consequently, there is no need to take into account the positional relation, movement range, and so forth of the connector carrier 10 or the housing carrier 20, and the configuration of the manufacturing apparatus, including jigs and so forth, can be simplified.

In the embodiment of the present invention shown in FIGS. 1 and 2, the carrier linkage parts 12 are provided to the outside of the outer periphery of the substantially cylindrical parts 34, and two of them are provided to the edge portions on the distal end side of the outer conductor shells 30, but the position of the carrier linkage parts 12 in the outer conductor shells 30 need only be such that the connector carrier 10 and the housing carrier 20 can be disposed on opposite sides. For instance, since the coaxial cable does not have to be forcefully and directly crimped in order to fix it to the outer conductor shell 30 (coaxial cable connector), the carrier linkage parts 12 can be provided to part of the edge portion between the distal end and the portion excluding the crimpers, namely, the covering crimpers 38 and the outer conductor crimpers 37 that directly crimp the covering and outer conductor of the coaxial cable. The configuration can be such that the walls 33 are not formed at the positions where the carrier linkage parts 12 are formed. For example, the carrier linkage parts 12 may be formed in place of those sections of the walls 33 from which the core wire crimpers 36 extend. Also, the positions of the carrier linkage parts 12 are not limited to part of the edge portion between the distal end and the portion excluding the crimpers of the outer conductor shells 30.

Figure 3:
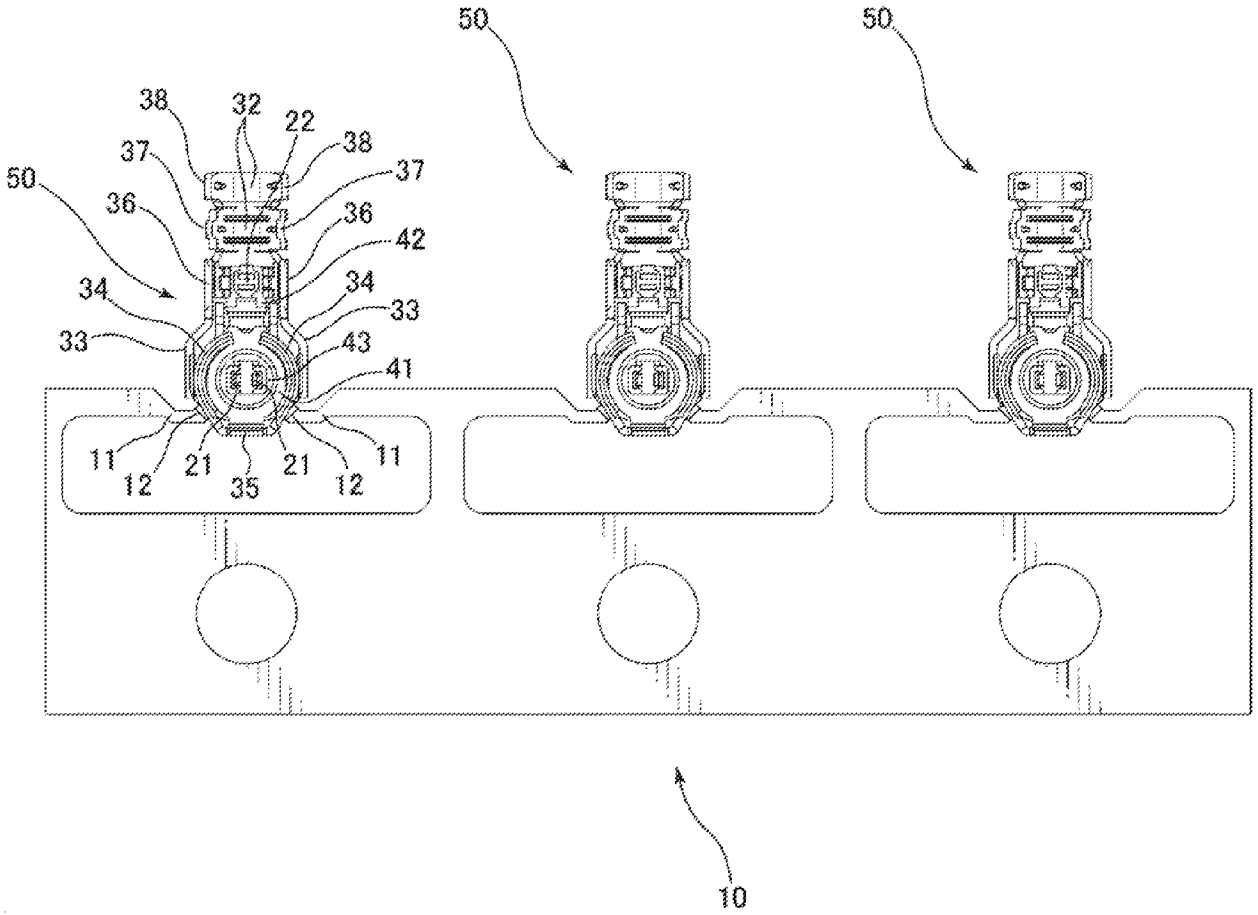
FIG. 3 An illustration of the carrier that links the coaxial cable connectors pertaining to an embodiment of the present invention.

FIG. 3 shows the carrier that links the coaxial cable connectors pertaining to an embodiment of the present invention. Carrier-equipped coaxial cable connectors 50 in a state of being linked to the connector carrier 10 are manufactured, for example, by cutting the carrier linking components 23 in a state in which the connector carrier 10 and the housing carrier 20 have been positioned (the state shown in FIG. 2) so that the housings 40 are disposed directly over the outer conductor shells 30 in the course of manufacturing the coaxial cable connectors, placing the housings 40 in the outer conductor shells 30, fixing the cylindrical bases 41 and the main body parts 42 with the substantially cylindrical parts 34 and the raised springs 39, and cutting the carrier linking components 23 to separate the housing carrier 20.

In this process, the carrier-equipped coaxial cable connectors 50 can be manufactured in a state of being linked to the connector carrier 10, and a plurality of coaxial cable connectors 50 can be wound and shipped on a reel in a state of being linked (not cut away from the connector carrier 10).

Figure 4:
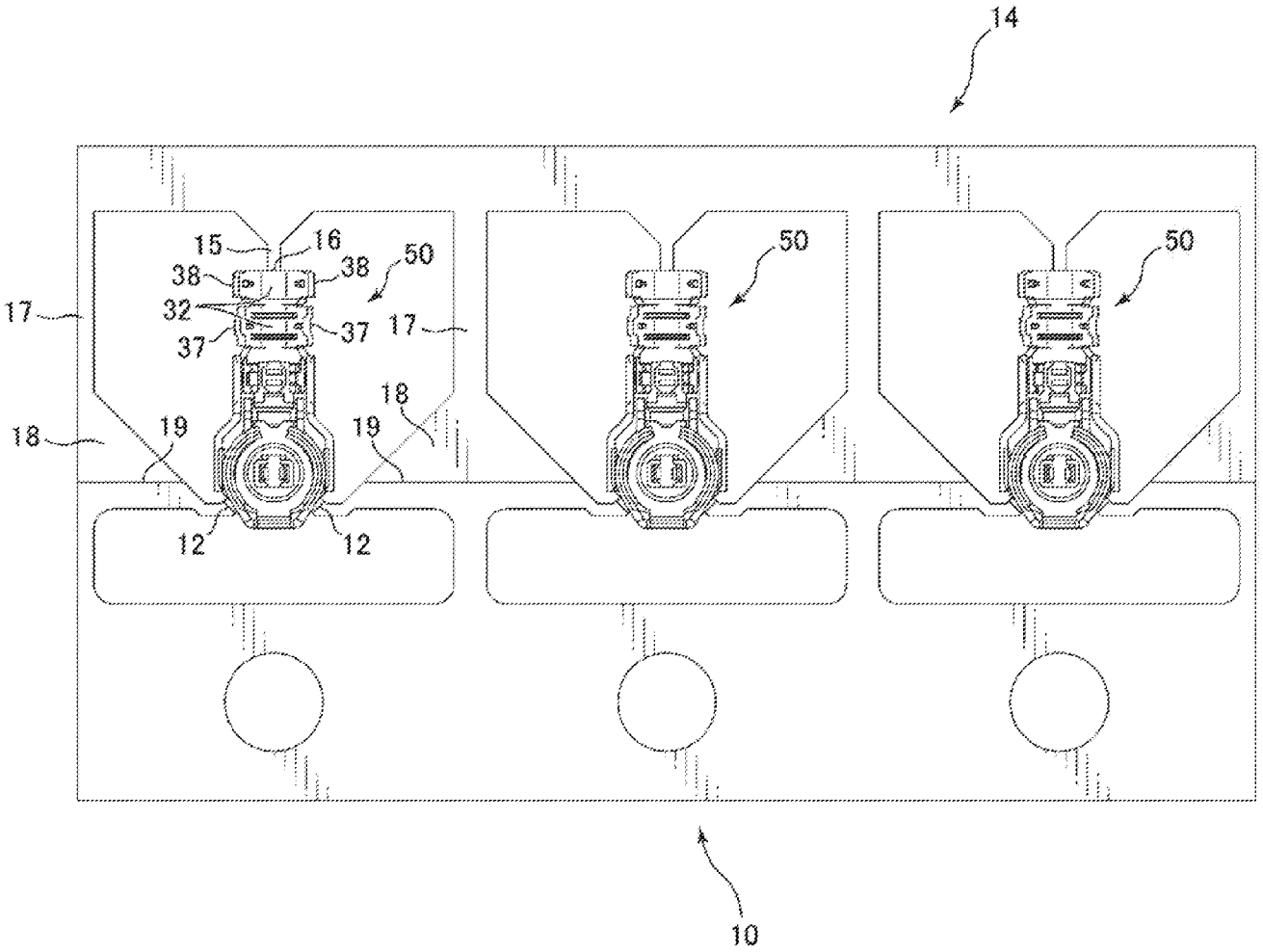
FIG. 4 An illustration of another embodiment of a carrier that links the coaxial cable connectors pertaining to an embodiment of the present invention.

FIG. 4 shows another embodiment of a carrier that links the coaxial cable connectors pertaining to an embodiment of the present invention. In the embodiment shown in FIG. 4, in addition to the connector carrier 10 linked on the distal end side of the coaxial cable connectors 50 shown in FIGS. 1 to 3, a sub-carrier 14 is linked to the crimpers on the rear end side of the coaxial cable connectors 50 (the covering crimpers 38 in the example in FIG. 4, but may also be the outer conductor crimpers 37). The sub-carrier 14 can securely support the outer conductor shells 30 along with the connector carrier 10 by linking the ends of the coaxial cable connectors 50 (e.g., the ends of the crimpers 32) with carrier linkage parts 16 via linking pieces 15. Preferably, the carrier linkage parts 16 of the sub-carrier 14 are formed in the plane of the base portion from which two tabs of the covering crimpers 38 extend (the plane corresponding to the back portion of the covering crimpers 38), that is, in the plane in which the plane of the housing accommodation components 31 extends to the rear end side, so that the flat faces of the outer conductor shells 30, the flat face of the connector carrier 10, and the flat face of the sub-carrier 14 all lie in the same plane (are flush), so the outer conductor shells 30 can be stably supported on each carrier.

Also, the sub-carrier 14 comprises support pieces 17 that extend through the side parts of the coaxial cable connectors 50, and flat supports 18 that spread out in a fan shape from the support pieces 17. The sub-carrier 14 is linked to the connector carrier 10 by the supports 18 via the support pieces 17. For example, the supports 18 of the sub-carrier 14 can link to the edges of the linking pieces 11 of the connector carrier 10 facing the supports 18. Because the supports 18 are fan shaped, they can support the connector carrier 10 (or the linking pieces 11) over a wider area, so in the manufacture of the coaxial cable connectors, there will be less variance in the outer conductor shells 30. That is, in the course of manufacturing the coaxial cable connectors, when the housings 40 are put into the outer conductor shells 30, the outer conductor shells 30 will be securely fixed by the supports 18, so assembly of the housings 40 can be carried out more easily. Cutting positions 19 are the positions that are cut when the sub-carrier 14 is separated from the connector carrier 10 and the coaxial cable connectors 50.

The steps for manufacturing a carrier-equipped coaxial cable connector shown in FIG. 4 are the same as those in the embodiment shown in FIGS. 1 to 3. The carrier-equipped coaxial cable connectors 50 in a state of being linked to the connector carrier 10 and the sub-carrier 14 are linked on the distal end side with the carrier linkage parts 12 of the connector carrier 10 and are linked on the rear end side with the carrier linkage parts 16 of the sub-carrier 14, and in a state in which the connector carrier 10 and the housing carrier 20 are positioned so that the housings 40 are disposed directly over the outer conductor shells 30 supported by the connector carrier 10 and the sub-carrier 14 (the same state as that shown in FIG. 2), the carrier linking components 23 are cut, the housings 40 are placed in the outer conductor shells 30, the cylindrical bases 41 and the main body parts 42 are fixed by the cylindrical parts 34 and the raised springs 39, respectively, and the carrier linking components 23 are cut to separate the housing carrier 20.

This process allows for the manufacture of the carrier-equipped coaxial cable connectors 50 in a state of being linked to the connector carrier 10 and the sub-carrier 14, and just as with the embodiment shown in FIGS. 1 to 3, a plurality of coaxial cable connectors 50 can be wound and shipped on a reel in a state of being linked, without being cut away from the connector carrier 10 and the sub-carrier 14.

The sub-carrier 14 can be removed by cutting the carrier linkage parts 16 and the cutting positions 19 from the carrier-equipped coaxial cable connectors 50 in a state of being linked to the connector carrier 10 and the sub-carrier 14, so as to obtain the carrier-equipped coaxial cable connectors 50 in a state of being linked to the connector carrier 10 as shown in FIG. 3. The manufacturing process after the removal of the sub-carrier 14, the step of connecting the coaxial cables 60 as shown in FIGS. 5 to 7, and so forth are the same as in the embodiment shown in FIGS. 1 to 3.

In another embodiment of the present invention shown in FIG. 4, in addition to the carrier linkage parts 12, there are provided carrier linkage parts 16 that are linked to the crimpers, namely, the covering crimpers 38 and the outer conductor crimpers 37, but the carrier linkage parts 12 that are linked to the connector carrier 10 can be provided at least at a desired location closer to the distal end side than the crimpers.

Figure 5:
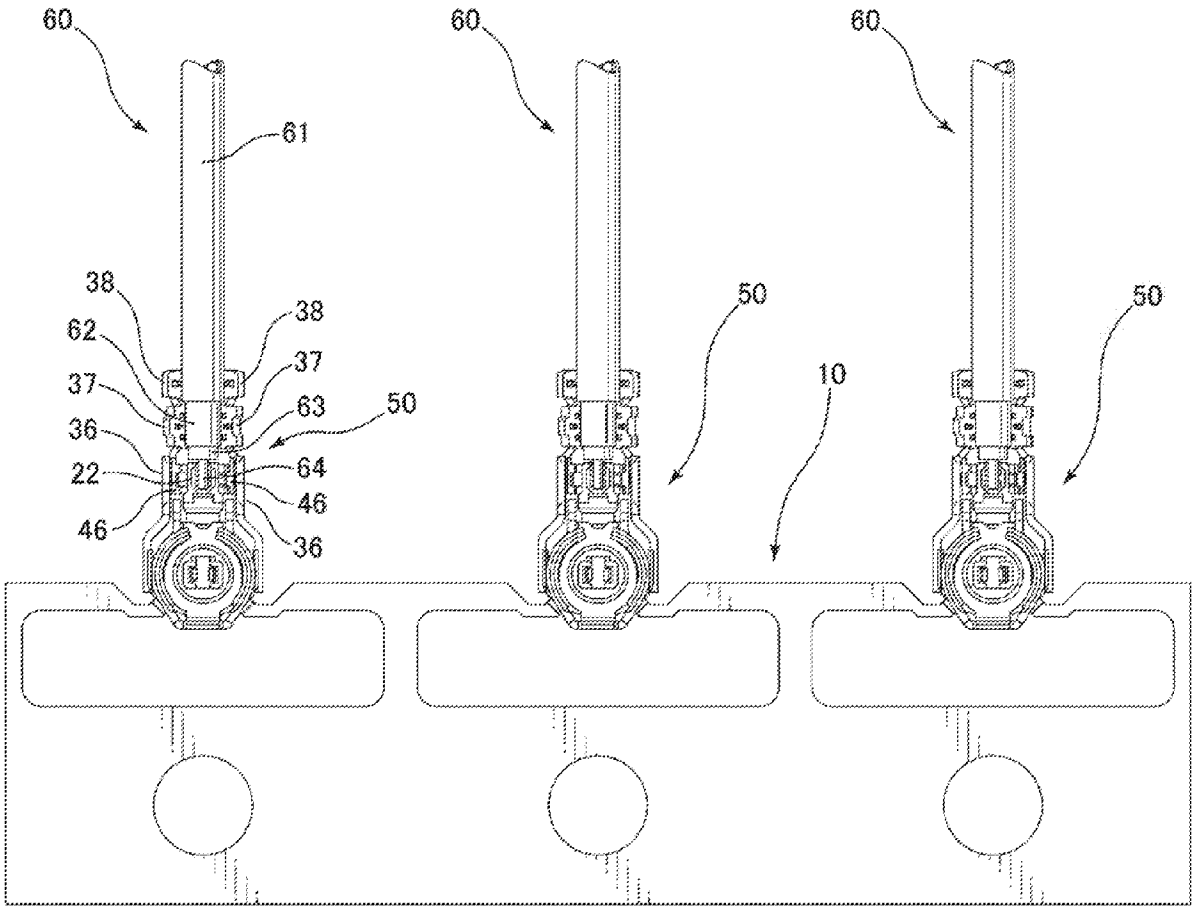
FIG. 5 An illustration of the state when coaxial cables have been disposed in the coaxial cable connectors.
Figure 6:
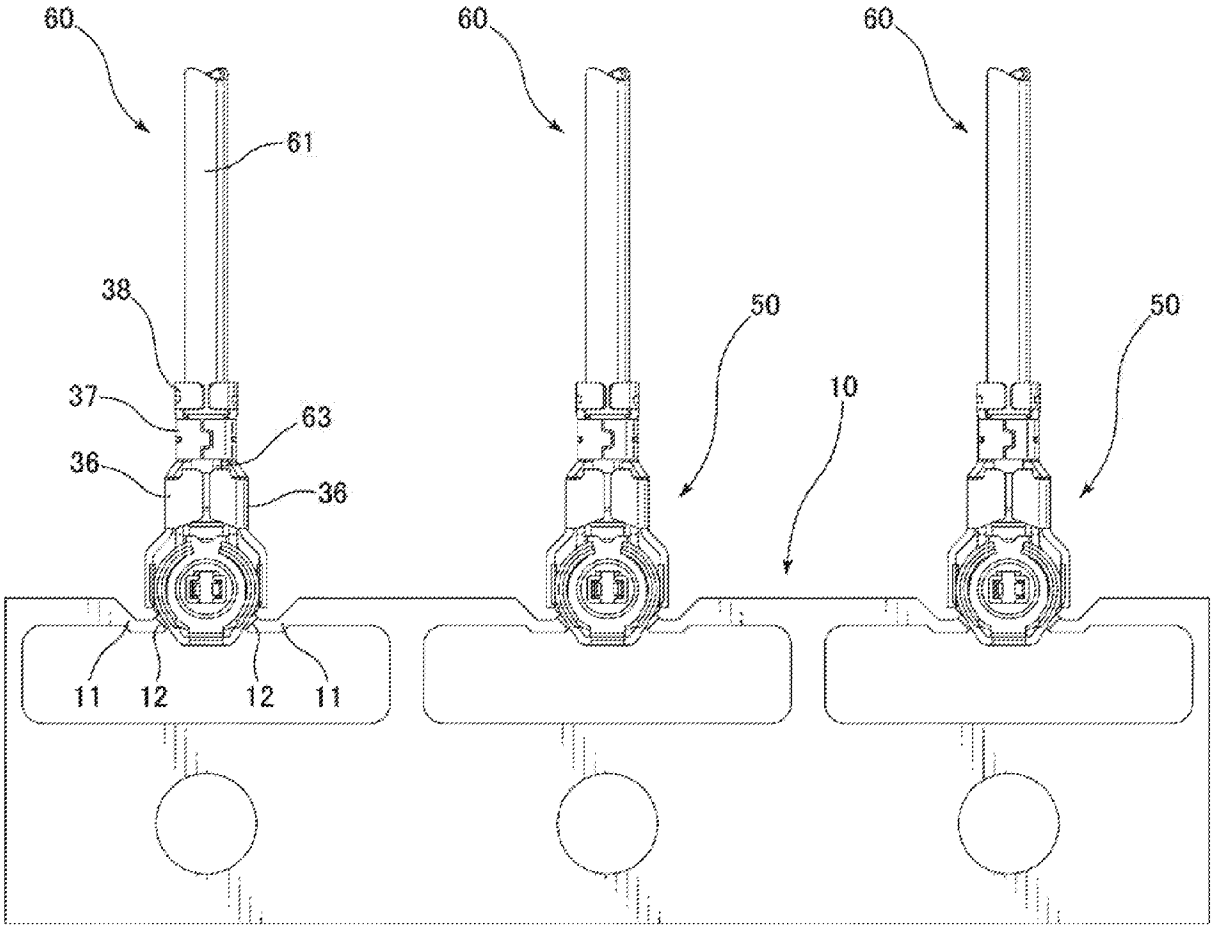
FIG. 6 An illustration of the state when the coaxial cables have been crimped from the state shown in FIG. 5.
Figure 7:
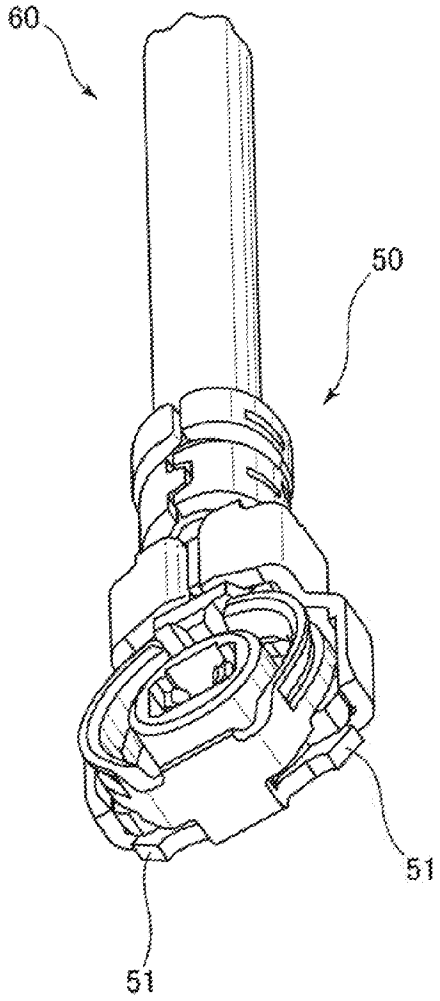
FIG. 7 An illustration of a coaxial cable connector that has been cut away from the connector carrier.

FIGS. 5 and 6 show the step of connecting the coaxial cables 60 to the carrier-equipped coaxial cable connectors 50. FIG. 5 shows the state when coaxial cables have been disposed in the coaxial cable connectors. The coaxial cables 60 are each made up of an insulated covering 61, an outer conductor 62, an insulator 63, and a core wire 64. The insulated covering 61 covers the outer conductor 62, the outer conductor 62 surrounds the insulator 63, and the insulator 63 surrounds the core wire 64. The core wire 64 of the coaxial cable 60 is disposed over the core wire connector 22 of a terminal, and the outer conductor 62 and the insulated covering 61 are disposed over the crimpers 32.

FIG. 6 shows the state when the coaxial cables have been crimped from the state shown in FIG. 5. The core wires 64 are compressed and connected to the core wire connectors 22 by the core wire fixing components 46 of the housings 40, which are on the inside, by crimping the core wire crimpers 36. The outer conductors 62 are fixed by crimping the outer conductor crimpers 37. The insulated coverings 61 are fixed by crimping the covering crimpers 38.

In the coaxial cable connector manufacturing process pertaining to an embodiment of the present invention and shown in FIGS. 2 to 6, the coaxial cables 60 are connected after the housings 40 have been put into the outer conductor shells 30, but the order of the manufacturing steps is not limited to the order shown in FIGS. 2 to 6. What is important is that the state in FIG. 6 is reached at the end. For example, as another embodiment of a coaxial cable connector manufacturing process, it is possible for the core wires 64 of the coaxial cables connectors 50 to be connected to the core wire connectors 22 of the terminals included in the housings 40, after which the housings 40 to which the core wires 64 are connected are placed in the outer conductor shells 30, which are still linked to the connector carrier 10. Also, as yet another embodiment of the manufacturing process, insulated housings that do not support terminals (or with no built-in terminals) are placed in the outer conductor shells 30 that are still linked to the connector carrier 10, after which coaxial cables in which core wires have already been connected to the core wire connectors of terminals for assembly in the insulated housings are placed in the housings as coaxial cable-equipped terminals.

Since the outer conductor shells 30 constituting the coaxial cable connectors 50 are still linked to the connector carrier 10, in the connection of the coaxial cables, the connector carrier 10 can be held down with a jig or the like to stabilize the fixing position of the coaxial cable connectors 50 linked to the connector carrier 10. Consequently, the clamps or other such mechanisms used for sandwiching and fixing the coaxial cable connectors themselves can be omitted. Also, as shown in FIG. 6, since the coaxial cable connectors 50 can be handled in a state of being linked to the connector carrier 10, steps such as inspection after the connection of the coaxial cables 60 can be carried out more easily.

FIG. 7 shows a coaxial cable connector that has been cut away from the connector carrier. That is, from a state (the state shown in FIG. 6) in which the coaxial cables 60 were connected to the coaxial cable connectors 50, FIG. 7 shows the state when the connector carrier 10 linked via the linking pieces 11 has been removed by cutting the carrier linkage parts 12.

The coaxial cable connector 50 shown in FIG. 7 comprises cut parts 51, which are formed in a convex shape at the edge portions of the outer conductor shells 30 by cutting the carrier linkage parts 12 at a position on the distal end side where the walls 33 of the outer conductor shells 30 are interrupted. The cut parts 51 are what is left behind after cutting the outer conductor shells 30 away from the connector carrier 10, and the positions at which the cut parts 51 are formed correspond to the positions of the carrier linkage parts 12. For example, the cut parts 51 are formed at the positions of the carrier linkage parts 12 provided to part of the edge portion between the distal end and the portion excluding the crimpers, namely, the covering crimpers 38 and the outer conductor crimpers 37, of the outer conductor shells 30. In the other embodiment of the present invention shown in FIG. 4, in addition to the cut parts 51 that are what is left behind after cutting at the carrier linkage parts 12, cut parts (not shown) that are what is left behind after cutting at the carrier linkage parts 16 are formed at the ends of the crimpers, but the cut parts 51 can be provided at least at the desired locations closer to the distal end side than the crimpers. If the carrier linkage parts 12 are provided to the outside of the outer periphery of the substantially cylindrical parts 34, then the cut parts 51 are also formed to the outside of the outer periphery of the substantially cylindrical parts 34.

Figure 8:
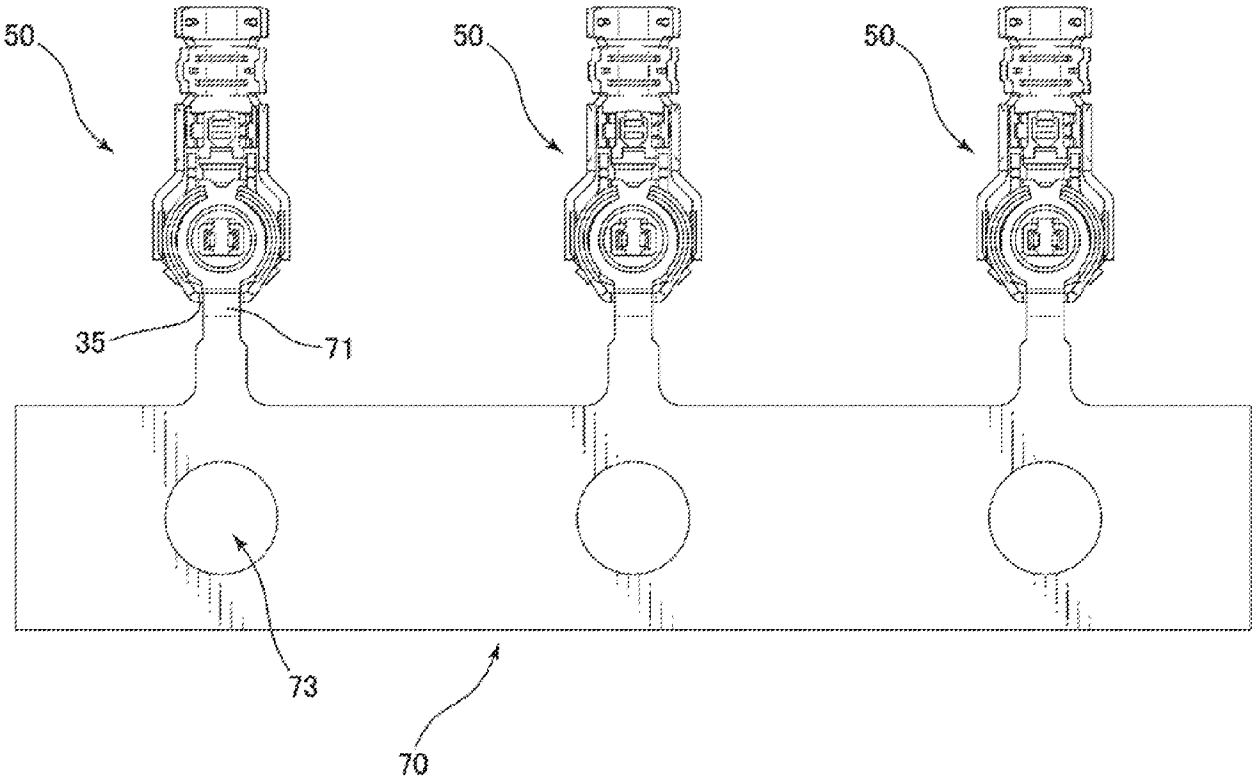
FIG. 8 An oblique view of the state when the insulated housings and the outer conductor shells constituting the coaxial cable connectors pertaining to another embodiment of the present invention are each linked to a carrier.
Figure 9:
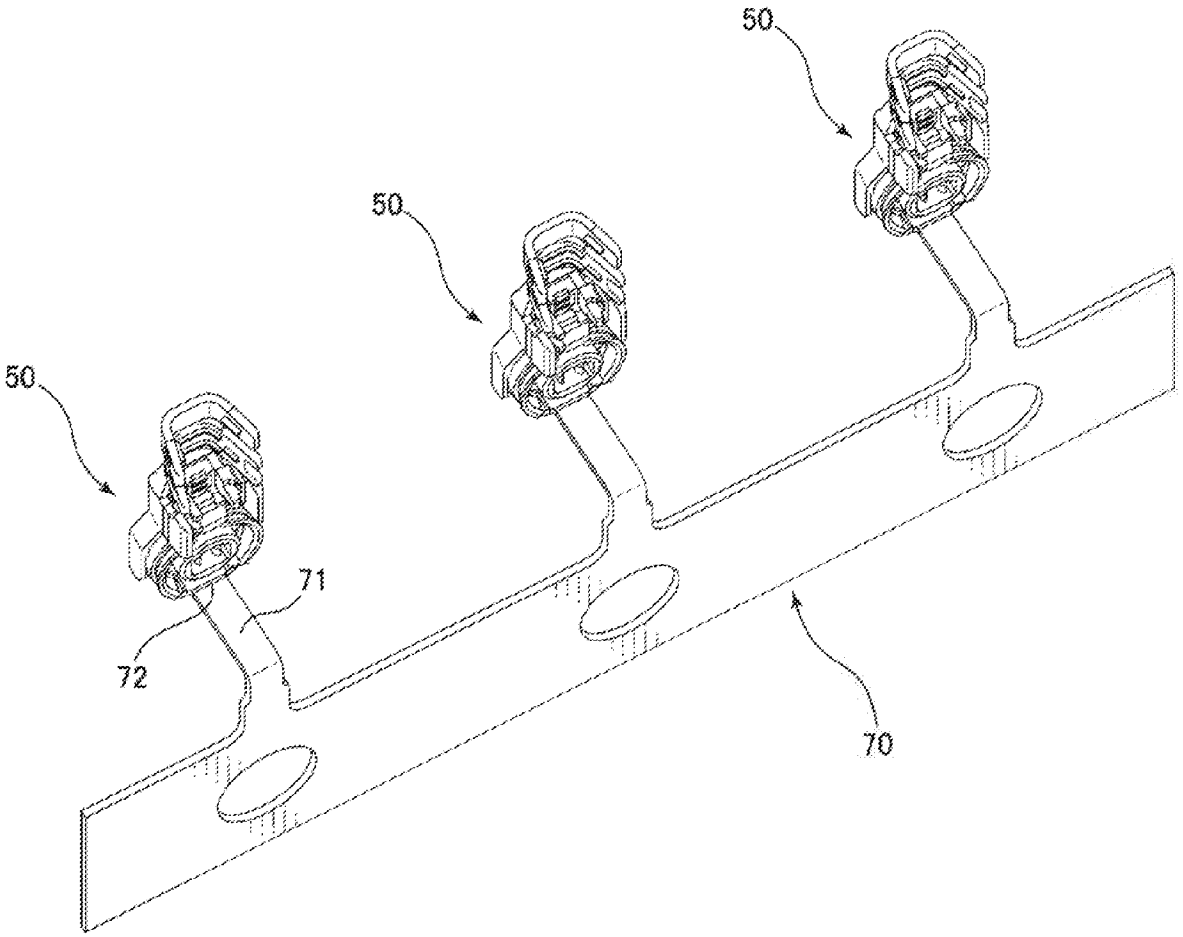
FIG. 9 A top view of the insulated housings and outer conductor shells shown in FIG. 8, as seen from above.

FIGS. 8 and 9 show another embodiment of the present invention. FIG. 8 is an oblique view of the state when the insulated housings and the outer conductor shells constituting the coaxial cable connectors pertaining to another embodiment of the present invention are each linked to a carrier. FIG. 9 is a top view of the insulated housings and outer conductor shells shown in FIG. 8, as seen from above.

In the embodiment shown in FIGS. 1 to 6, the connector carrier 10 and the carrier linkage parts 12 are provided to the edge portions on the distal end side of the outer conductor shells 30, but as discussed above, the positions of the carrier linkage parts need only be positions at which the connector carrier and the housing carrier can be disposed on opposite sides. For example, the carrier linkage parts can be in any location between the distal end and the portion excluding the crimpers, namely, the covering crimpers 38 and the outer conductor crimpers 37, or the outer conductor shells 30. In another embodiment of the present invention shown in FIGS. 8 and 9, a connector carrier 70 is linked to the upper ends of the bending parts 35 of the coaxial cable connectors 50 by carrier linkage parts 72 via linkage pieces 71. The linkage pieces 71 extend from the end of the connector carrier 70, perpendicular to the plane of the connector carrier 70, and are linked to the upper ends of the bending parts 35 of the coaxial cable connectors 50. Positioning pilots 73 that serve as references for positioning the outer conductor shells 30 in the manufacture of the coaxial cable connectors can be provided to the connector carrier 70 as needed.

As shown in FIGS. 8 and 9, when the carrier linkage parts 72 are provided at the boundary of the upper ends of the bending parts 35, the connector carrier 70 can be disposed at a position on the opposite side from the housing carrier 20. Consequently, there is no need to take into account the movement range of the connector carrier 70 and the housing carrier 20, their positional relation, and so forth, and the configuration of the manufacturing apparatus, including jigs and so forth, can be simplified.

Individual working examples of the present invention are not limited to independent working examples, and can be suitably combined with each other.

FIELD OF INDUSTRIAL UTILIZATION

A method for manufacturing a coaxial cable connector and a connector carrier-equipped coaxial cable connector in which one or more of the coaxial cable connectors pertaining to the present invention are linked can be utilized in a coaxial cable connector manufacturing process, and the coaxial cable connector thus manufactured can be used in electrical signal transmission in compact electronic devices, etc.

DESCRIPTION OF THE REFERENCE NUMERALS

10 connector carrier
11 linking piece
12 carrier linkage part
13 positioning pilot
14 sub-carrier
15 linking piece
16 carrier linkage part
17 support piece
18 support
19 cutting position
20 housing carrier
21 contact
22 core wire connector
23 carrier linking component
24 linking piece
25 positioning pilot
30 outer conductor shell
31 housing accommodation component
32 crimper
33 wall
34 substantially cylindrical part

35 bending part
36 core wire crimper
37 outer conductor crimper
38 covering crimper
39 raised spring
40 housing
41 cylindrical base
42 main body part
43 cylindrical part
44, 45 protrusion
46 core wire fixing component
50 coaxial cable connector
51 cut part
60 coaxial cable
61 insulated covering
62 outer conductor
63 insulator
64 core wire
70 connector carrier
71 linkage piece
72 carrier linkage part
73 positioning pilot

The invention claimed is:

1. A coaxial cable connector that includes:

a housing that supports terminals, an outer conductor shell that covers at least part of the housing and at least part of a coaxial cable, and a coaxial cable;

wherein a crimper configured to fix the coaxial cable is provided to the rear end portion of the outer conductor shell, cut parts are provided to the outer conductor shell at least at desired locations closer to a distal end side than the crimper, the cut parts are maintained after cutting away from a connector carrier, and the cut parts are formed at the edge portions closer to the distal end side than the crimper, the coaxial cable connector further including a substantially cylindrical part configured to connect a mating connector to the distal end side of the outer conductor shell, wherein the cut parts are formed to the outside of the outer periphery of the substantially cylindrical part, wherein the coaxial cable connector includes a bending part at the distal end of the outer conductor shell, and the carrier linkage part is formed at an end of the bending part, wherein the carrier linkage part extends from a plane of a housing accommodation component, and wherein the at least one coaxial cable connector is a right-angle coaxial connector.

2. The coaxial cable connector according to claim 1, wherein wall components are provided to the edge portions of the outer conductor shell, and the cut parts are formed at the edge portions of the outer conductor shell where the wall components are not located.

3. The coaxial cable connector according to claim 1, wherein the cut parts are formed in a convex shape from the edge portions of the outer conductor shell.

4. The coaxial cable connector according to claim 1, comprising a bending part that constitutes part of the substantially cylindrical part, at the distal end of the outer conductor shell, wherein the cut parts are formed at the ends of the bending part.

5. The coaxial cable connector according to claim 1, further comprising other cut parts at the end of the crimper, wherein the cut parts are provided at desired locations closer to the distal end side than the crimper.

6. The coaxial cable connector according to claim 1, comprising a bending part that constitutes part of the substantially cylindrical part, at the distal end of the outer conductor shell, wherein the carrier linkage part comprises carrier linkage parts disposed adjacent to both sides of the bending part.

7. A connector carrier-equipped coaxial cable connector, which includes:

at least one coaxial cable connector comprising terminals, a housing that supports the terminals, and an outer conductor shell that covers at least part of the housing and at least part of a coaxial cable, a crimper configured to fix the coaxial cable is provided to the outer conductor shell, with respect to the outer conductor shell, a carrier linkage part that is linked to the connector carrier is provided at a desired location closer to a distal end side than the crimper, and cut parts are provided to the outer conductor shell at least at desired locations closer to a distal end side than the crimper, wherein the cut parts are maintained after cutting away from a connector carrier, wherein the coaxial cable connector includes a bending part that constitutes part of a substantially cylindrical part, at the distal end of the outer conductor shell, and the carrier linkage part is formed at an end of the bending part, and wherein the bending part is configured as a plate from which the substantially cylindrical part extends.

8. The connector carrier-equipped coaxial cable connector according to claim 7, wherein the carrier linkage part is provided to the edge portions closer to the distal end side than the crimper.

9. The connector carrier-equipped coaxial cable connector according to claim 7, wherein the connector carrier comprises wall components at the edge portions of the outer conductor shell, and the carrier linkage part is provided to the edge portions of the outer conductor shell where the wall components are not located.

10. The connector carrier-equipped coaxial cable connector according to claim 7, wherein the coaxial cable connector includes a substantially cylindrical part configured to connect a mating connector to the distal end side of the outer conductor shell, and the carrier linkage part is provided to the outside of the outer periphery of the substantially cylindrical part.

11. The connector carrier-equipped coaxial cable connector according to claim 7, wherein the carrier linkage part is formed in a convex shape from the edge portion of the outer conductor shell.

12. The connector carrier-equipped coaxial cable connector according to claim 7, wherein the coaxial cable connector is engaged with the carrier linkage part via a linkage piece extending from the connector carrier.

13. The connector carrier-equipped coaxial cable connector according to claim 7, wherein a notch or a half-cut is formed in the carrier linkage part.

14. The connector carrier-equipped coaxial cable connector according to claim 7, comprising another carrier linkage part at the end of the crimper, and wherein the carrier linkage part is provided at a desired location closer to the distal end side than the crimper, the other carrier linkage part is linked to a sub-connector carrier that supports the crimper of the outer conductor shell, and the connector carrier is connected to a support component at the distal end of a support piece extending from the sub-connector carrier.

15. A method for manufacturing a coaxial cable connector, including:

cutting away the connector carrier by cutting the carrier linkage part provided at a desired location closer to the distal end side than the crimper from the connector carrier-equipped coaxial cable connector according to claim 7, wherein the crimper includes a covering crimper and an outer conductor crimper, the outer conductor shell of the coaxial cable connector further comprises a core wire crimper, and prior to the cutting away the connector carrier, the following are performed:

fitting the housing that supports the terminals into the outer conductor shell; and bending the core wire crimper extending from the edge portion of the outer conductor shell so that the core wire of the coaxial cable disposed in a core wire connector of the terminals is compressed and connected to the core wire connector by a core wire fixing component that is insulated and is located on the inside of the core wire crimper, and respectively crimping and fixing the outer conductor and the covering of the coaxial cable with the outer conductor crimper and the covering crimper provided to the rear end portion of the outer conductor shell, wherein the carrier linkage part linking the outer conductor shell to the connector carrier and the carrier linkage part linking the housing to the housing carrier are disposed at opposite ends of the conductor shell and the housing, respectively, wherein the housing is assembled to the outer conductor shell while attached to the housing carrier, wherein the carrier linkage part linking the housing to the housing carrier is cut before the carrier linkage part linking the outer conductor shell to the connector carrier, and wherein the housing and the coaxial cable are attached from a same direction with respect to the outer conductor shell.

16. A method for manufacturing a coaxial cable connector, including at least:

cutting a sub-carrier away from the connector carrier by cutting the other carrier linkage part provided to the end of the crimper from the connector carrier-equipped coaxial cable connector according to claim 14, and cutting between the connector carrier and the support component at a cutting location, and cutting away the connector carrier by cutting the carrier linkage part provided at a desired location closer to the distal end side than the crimper.

17. The method for manufacturing a coaxial cable connector according to claim 15, prior to the cutting away the connector carrier, the following are performed:

connecting the core wire of the coaxial cable to the core wire connector of the terminals supported in the housing;

fitting the housing that supports the terminals, in which the core wire of the coaxial cable is wired to the core wire connector, into the outer conductor shell; and bending the core wire crimper extending from the edge portion of the outer conductor shell so that the housing that supports the terminals is fixed to the outer conductor shell, and crimping and fixing the outer conductor and the covering of the coaxial cable with the outer conductor crimper and the covering crimper provided to the rear end portion of the outer conductor shell.

18. The method for manufacturing a coaxial cable connector according to claim 15, prior to the cutting away the connector carrier, the following are performed:

fitting an insulated housing that does not support any terminals;

fitting terminals, in which the core wire of the coaxial cable is connected to the core wire connector, to the housing; and bending the core wire crimper extending from the edge portion of the outer conductor shell so that the housing that supports the terminals is fixed to the outer conductor shell, and crimping and fixing the outer conductor and the covering of the coaxial cable with the outer conductor crimper and the covering crimper provided to the rear end portion of the outer conductor shell.

19. The method for manufacturing a coaxial cable connector according to claim 15, wherein the housing is formed with integral support for terminals included in the housing and the housing carrier is linked to the terminals with the housing carrier linking part via linking pieces, and wherein the housing carrier linking part extends to support the terminals included in the housing.

20. The method for manufacturing a coaxial cable connector according to claim 15, wherein substantially cylindrical parts of the outer conductor shell are bent to fix cylindrical parts of the housing to the outer conductor shell.

* * * * *